US005350659A

United States Patent [19]

Lee et al.

[11] Patent Number: 5,350,659

[45] Date of Patent: Sep. 27, 1994

[54] PREPARATION OF CONDUCTIVE TONERS USING FLUIDIZED BED PROCESSING EQUIPMENT

[75] Inventors: Frank P. Lee; Sheau V. Kao; Gerald R. Allison, all of Oakville; Hadi K. Mahabadi, Etobicoke; Geroge Liebermann, Mississauga, all of Canada; Gopalan Vijayakumar, Fremont; Robert A. Downing, San Jose, both of Calif.

[73] Assignee: Xerox Corporation, Stamford, Conn.

[21] Appl. No.: 40,965

[22] Filed: Mar. 31, 1993

[51] Int. Cl.[5] ..... G03G 5/00

[52] U.S. Cl. ..... 430/137

[58] Field of Search ..... 430/137

[56] References Cited

U.S. PATENT DOCUMENTS

| | | | |
|---|---|---|---|
| 2,648,609 | 8/1953 | Wurster | 427/213 |
| 2,788,297 | 4/1957 | Louis | 427/108 |
| 2,799,241 | 7/1957 | Wurster | 118/24 |
| 2,879,173 | 3/1959 | Yacoe | 428/407 |
| 3,036,338 | 5/1962 | Nack | 264/7 |
| 3,196,032 | 7/1965 | Seymour | 430/137 |
| 3,241,520 | 3/1966 | Wurster et al. | 118/62 |
| 3,253,944 | 5/1966 | Wurster | 427/213 |
| 3,639,245 | 2/1972 | Nelson | 430/109 |
| 4,835,082 | 5/1989 | Koishi et al. | 430/109 |
| 5,153,092 | 10/1992 | Kao et al. | 430/137 |

*Primary Examiner*—Marion E. McCamish
*Assistant Examiner*—Mark a. Chapman
*Attorney, Agent, or Firm*—Oliff & Berridge

[57] ABSTRACT

A method for making conductive toner particles includes (A) heat treating in fluidized bed processing equipment a mixture of non-conductive toner particles containing a thermoplastic resin and a colorant, and an effective amount of conductive powder blended with and coated on surfaces of the non-conductive toner particles, wherein the heat treatment is carried out at a temperature at or above the glass transition temperature of the resin for a period of time at least sufficient to fuse the conductive powder onto the surfaces of the non-conductive toner particles, and then (B) cooling the heated conductive toner particles to a temperature below the glass transition temperature of the resin. The final toner particles have a conductivity of at least about $10^{-8}$ $ohm^{-1}$-$cm^{-1}$ and preferably from about $10^{-4}$ to about $10^{-8}$ $ohm^{-1}$-$cm^{-1}$.

17 Claims, No Drawings

PREPARATION OF CONDUCTIVE TONERS USING FLUIDIZED BED PROCESSING EQUIPMENT

BACKGROUND OF THE INVENTION

This invention relates to conductive single-component developers. More particularly, this invention relates to methods for making conductive dry toners which are suitable for developing an electrostatic latent image formed by electrophotography, electrostatic recording, ionography and the like.

Recording systems for visualizing image information through an electrostatic latent image, such as electrophotography, are now widespread in various fields. In electrophotography, an electrophotographic photoreceptor is charged and then exposed to light to form an electrostatic latent image, the latent image is developed with a developer containing a toner, and the toner image is transferred and fixed. Developers used in electrophotography include two-component developers containing a toner and a carrier, and single-component developers containing a toner and no carrier.

Conductive toners for single-component developers used in electrophotography and methods for making them are disclosed, for example, in U.S. Pat. Nos. 3,639,245 (Nelson) and 3,196,032 (Seymour).

According to the method taught in the Nelson patent, a dry-powder blend is first obtained by any of several standard means, for example, by melting a resin, stirring in the solid filler, if any, allowing the mixture to cool, then grinding and classifying to the appropriate particle size range of approximately 1 to 15 microns diameter. This powder, which is pseudocubical in shape, is then "spheroidized" by aspirating the powder into a moving gas stream, preferably air, thus creating an aerosol, and directing the aerosol at about 90° (plus or minus 5°) through a stream of hot air, which has been heated to about 900°–1100° F., into a cooling chamber, where the powder is then allowed to settle by gravity while it cools. The resulting powder is made up of substantially spherical particles. It is then dry blended with conductive powder, such as conductive carbon black, and the mixture is directed at about 90° (plus or minus 5°) through a stream of gas, preferably air, heated to a temperature (e.g., 700°–800° F.) which can at least soften and desirably melt the thermoplastic resin in the particles and maintain that softened or molten condition for a period of time sufficient to permit the conductive powder to become essentially completely embedded onto the resin particle surface, due to the effects of surface tension.

A drawback to the Nelson method is that the high temperature (700°–800° F.) used therein allows for only a brief heat treatment period, several seconds, for the toner/conductive powder mixture. Longer heat treatment periods could cause the toner/conductive powder particles to soften to the point that they would begin to adhere together. The short heat treatment period reduces tolerance for variations in operating temperatures and process times, resulting in poor control of the process. Poor process control in turn limits the variations which can be made to the process to adjust the final properties of the toner.

U.S. Pat. No. 3,196,032 to Seymour discloses a method of making electrostatic ink powder by means of fluid bed processing equipment. In the Seymour method, a dry mixture of resin particles and conductive powder particles is introduced into fluid bed processing equipment, wherein pressurized dry air is passed upwardly through the mixture to form a dense phased fluidized mass. A solvent vapor in which the resin is soluble is passed through the mixture, whereby the resin powder is slightly softened and made relatively tacky so that particles of the conductive powder become partially embedded in and bonded to the surfaces of the resin material. The fluidized mass is then dried with pressurized air without the solvent to a powder consistency. The particle size of the resin powder is preferably 25–50 microns and the particle size of the conductive powder is preferably 8–25 millimicrons.

Disadvantages of the Seymour method include its use of particles which are typically too large for modern toners (the larger the toner particle size, the lower the resolution of the print) and its use of a solvent. Drawbacks to solvent use include higher costs due to the use of an additional ingredient (solvent), environmental hazards commonly associated with solvents, and problems involved in removing solvent after completion of the process.

SUMMARY OF THE INVENTION

The present invention is directed to a method for making conductive toner particles, comprising (A) heat treating in fluidized bed processing equipment a mixture of non-conductive toner particles comprising a thermoplastic resin and a colorant, and an effective amount of conductive powder blended with and coated on surfaces of the nonconductive toner particles, wherein said heat treatment is carried out at a temperature at or above the glass transition temperature of the resin for a period of time at least sufficient to fuse the conductive powder onto the surfaces of the non-conductive toner particles, and then (B) cooling the heated toner particles to a temperature below the glass transition temperature of the resin.

The heat treatment is typically carried out at a temperature in the range of 80°–150° C. and for a period of at least 30 minutes.

Heat treatment causes the conductive powder to fuse onto the toner particle surfaces. This surface modification of the toner results in improved print background and increased toner conductivity. Without heat treatment, conductive material not fused onto the toner surface may be deposited onto the wrong place on prints to cause "background". Toner which has not been heat treated will usually require more conductive powder to obtain the same conductivity.

The heat treatment process of the invention allows a heat treatment at lower temperature and a longer heat treatment period for the particles. This results in lower energy costs and improved process control and allows process variations needed for adjusting toner properties. Other advantages include its use of smaller particles and nonuse of a solvent.

The final toner particles have a conductivity of at least about $10^{-8}$ $ohm^{-1}$-$cm^{-1}$ and preferably from about $10^{-4}$ to about $10^{-8}$ $ohm^{-1}$-$cm^{-1}$.

The single-component developers prepared according to the methods of this invention have excellent conductivity and flowability, and can replace liquid developers presently used in electrographic printers and plotters and ionographic printers.

DETAILED DESCRIPTION OF PREFERRED EMBODIMENTS

In the method of this invention, a mixture of non-conductive toner particles and colorant, e.g., pigments and/or magnetic components, is blended and coated with conductive powder, then heat treated in fluidized bed processing equipment, wherein the coated toner particles are suspended in hot air and heated to a temperature at or above the glass transition temperature of the resin in the toner. The heat treatment will last at least until the conductive powder particles are fused onto the surfaces of the toner particles. Typically, the heat treatment will be carried out for at least 30 minutes and preferably for a period ranging from about 30 to about 200 minutes. After heat treatment is complete, the toner particles are cooled to a temperature below the glass transition temperature of the toner resin. After removal from the fluidized bed processing equipment, the conductive toner particles may be classified to remove excess or unfused conductive powders.

Fluidized bed processing equipment is known. The fluidized bed processing equipment used in this invention is preferably a "re-engineered" fluidized bed dryer which contains a laminated membrane filter bag (e.g. Gore-Tex ® membrane) wherein a Teflon ® (tetrafluoroethylene fluorocarbon) membrane is bonded to a polyester or nylon substrate. Fine particles are recaptured by the filter bag and returned to the bed. Furthermore, a preferred fluidized bed dryer which may be used in this invention contains a product container having a 200–400 mesh stainless steel screen bottom which allows air to pass through. The fluidized bed processing equipment used in the present invention is preferably a batch fluidized bed dryer.

Toners made conductive by the methods of this invention generally contain a thermoplastic resin and a colorant. The toners can be prepared by a number of known methods, including mechanical blending and melt blending the toner components followed by mechanical attrition. Other methods include those well known in the art such as spray drying, mechanical dispersion, melt dispersion, dispersion polymerization, and suspension polymerization.

Preferably, the toners are prepared by the simple mixing of thermoplastic resin, colorant, and, optionally, additive particles, while heating, followed by cooling, micronization to produce toner size particles of, for example, an average diameter of from about 1 to about 20 microns, and subsequently classifying these particles for the primary purpose of removing fines, e.g., particles with a diameter of 5 microns or less, and very large coarse particles, e.g., those with a diameter of greater than 30 microns.

The toner particles can be prepared in a similar manner with an extrusion device wherein the product exiting from such a device is cut into pieces, pulverized and classified.

Thermoplastic resins suitable for use in the toner particles treated in the present invention are known in the art and include, for example, polyesters, urethane modified polyesters, co-polyesters, B-stage (i.e., partially cured) phenol aidehyde polymers, polyvinyl acetate, epoxy resins, polyamides, acrylic resins, polyamino acid esters, polycarbonates, copolycarbonates, liquid crystalline polycarbonates, polyvinyl formal, polyvinyl butyral, polyvinyl alkyl ether, polyalkylene ether, polyurethanes and copolymers of styrene such as styrene butadiene, styrene butylacrylate, and other resins which are known to be useful in making toners. The preferred resin for use in the present invention is a polyester resin.

The preferred polyester resins used in the present invention are typically obtained by polycondensation of a polycarboxylic acid and a polyhydric alcohol. Examples of such polycarboxylic acids include aliphatic dibasic acids and malonic acids, succinic acids, glutaric acids, adipic acids, azelaic acids, sebacic acids and hexahydrophthalic anhydrides; such aromatic dibasic acids as phthalic anhydride, phthalic acid, terephthalic acid and isophthalic acid; and lower alkyl esters thereof.

Examples of suitable polyhydric alcohols include diols such as ethylene glycol, 1,2-propylene glycol, 1,3-propylene glycol, 1,3-butylene glycol, 1,4-butylene glycol, 1,6-hexanediol, neopentyl glycol, diethylene glycol, dipropylene glycol, hydrogenated bisphenol A and bisphenol A-propylene oxide adducts; and triols such as glycerin, trimethylol propane and trimethylol ethane. The preferred polyhydric alcohols are bisphenol A-propylene oxide adducts.

Suitable polycondensation methods include, for instance, commonly known high temperature polycondensation and solution polycondensation methods.

The molecular weight of the polyester resin preferably ranges from about 1,000 to about 20,000 expressed in number-averaged molecular weight (Mn) as measured by gel permeation chromatography (GPC), and from about 2,000 to about 40,000 expressed in weight-averaged molecular weight (Mw). The onset glass transition temperature (Tg) as measured by differential scanning calorimetry (DCS) is in the range typically from about 50° C. to 70° C.

The thermoplastic resin is present in the toner composition in an amount preferably ranging from about 30 to about 98, more preferably from about 30 to about 95, and most preferably from about 40 to about 85, percent by weight.

Examples of suitable colorants which can be combined with the resin include carbon black, Nigrosine dye, magnetic particles, magenta, cyan, yellow particles, aniline blue, Alkoyl Blue, chrome yellow, Ultramarine Blue, Quinoline Yellow, Methylene Blue, Phthalocyanine Blue, Malachite Green, Rose bengale, and phthalocyanine derivatives. Mixtures of known magnetic colorants may also be used. Magnetic colorants are preferred. Examples of magnetic colorants which can be blended with the resin include magnetite; metals such as iron, cobalt and nickel; and metal oxides such as $Fe_2O_3$, $Fe_3O_4$ and the like. Magnetite is preferred as the magnetic colorant, and Mapico Black is most preferred.

The colorant is generally used in sufficient quantities so as to render the toner highly colored, which enables the formation of a visible image on a recording member. Thus, for example, a non-magnetic colorant may be present in the toner composition in an amount ranging from about 2 to about 15 percent by weight, and preferably from about 2 to about 10 percent by weight. A magnetic colorant is typically present in the toner in an amount ranging from about 5 to about 70 percent by weight and preferably from about 15 to about 60 percent by weight.

The toner compositions treated in this invention may further contain charge controlling additives, fillers and other additives.

Any of the conventionally known charge controlling additives may be incorporated into toner compositions of this invention. Examples of such additives include Nigrosine; triphenylmethane type dyes; chromium complex of 3,5-di-tert-butyl salicylic acid; alkyl pyridinium halides, e.g., cetyl pyridinium chloride; organic sulfates and sulfonates, e.g., distearyl dimethyl ammonium methyl sulfate. Also suitable are charge controlling additives which have been surface treated with colloidal silicas such as Aerosils; mixtures of colloidal silicas and charge controlling additives; colloidal silicas surface treated with charge control additives; and the like.

Charge controlling additives may be present in the toner compositions in an amount ranging from about 0.05 to about 10 percent by weight, preferably from about 1 to about 5 percent by weight, and most preferably from about 0.5 to about 2 percent by weight.

Any of the conventionally known additives can also be used in the toner compositions. Examples of such additives include fillers such as colloidal silica, zinc stearate, low molecular weight polyethylene, low molecular weight polypropylene, stearic acid amide, methylene bisstearoamide and the like.

Other additives which can be incorporated in the toner compositions include, e.g., plasticizers, dyestuffs, and powdered flow agents.

After formation of the toner particles, the toner composition is dry blended with a conductive powder. Examples of suitable conductive powders include conductive carbon black, metals, metal alloys, and metal oxides. Examples of suitable metals include aluminum, copper, gold, silver, platinum, palladium, and titanium. Examples of suitable metal alloys are nickel-chromium and copper-indium. Suitable metal oxides include indium oxide and a tin oxide-antimony oxide complex.

Preferably, the conductive powder is carbon black.

The "effective amount" of conductive powder is that amount sufficient to provide toner particles having a conductivity for use in developing electrostatic latent images, e.g., at least about $10^{-8}$ $ohm^{-1}cm^{-1}$ and preferably from about $10^{-4}$ to about $10^{-8}$ $ohm^{-1}$-$cm^{-1}$. Typically, the conductive powder is used in an amount ranging from about 0.5 to about 5 parts by weight, and preferably from about 1 to about 3 parts by weight, per 100 parts by weight of the non-conductive toner.

The non-conductive toner particles generally have a volume average particle diameter of less than 20 microns and preferably from about 7 to about 18 microns.

The blend of toner and conductive powder is then deposited into the container of the fluidized bed processing equipment for heat treatment.

Heated air which may be generated by a steam heater or the like is drawn into the container of the fluidized bed processing equipment by an exhaust fan to heat and fluidize the toner particles. Generally, the toner particles are heated to a temperature above the glass transition temperature of the resin used to prepare the toner. Although the specific temperature of the heat treatment will depend on the specific resin used in the toner, typically a temperature in the range of 80° C. to 150° C. will be sufficient. If the resin is polyester resin, the preferred inlet air temperature range is 90° C. to 120° C. Once they are fluidized, the particles are surrounded by air which prevents them from adhering to each other even if their surfaces are softened. After a sufficient time, e.g., at least about 30 minutes and typically from 30 to 200 minutes, the conductive powder particles embed themselves in the surface of the resinous particles and become bonded into the resinous particles. Thereafter, the toner particles are cooled to a temperature below the glass transition temperature of the resin. Cooling can be effected by turning off the steam heater and continuing the fluidization with ambient temperature air.

The cooled toner particles are then removed from the fluidized bed processing equipment. Excess or unreacted conductive powder particles can then be removed by means of a classifier, elutriator, winnower, or the like.

The final conductive toner particles produced by the methods of this invention will typically have a particle size of from about 1 to about 20 microns, and a conductivity of from about $10^{-4}$ to about $10^{-8}$ $ohm^{-1}$-$cm^{-1}$.

EXAMPLE

The following example presents a preferred but nonlimiting method within the scope of this invention for making conductive dry magnetic toner particles.

A mixture of 50% by weight of polyester resin and 50% by weight of magnetite (specifically, Columbia Mapico Black) is blended using a Lightnin Labmaster blender for 10 minutes at a tumbling rate of 30 rpm and an agitating bar speed of 2000 rpm. The mixture is then fed at a rate of about 1 pound per hour to a DAVO 25 mm counter-rotating twin screw extruder maintained at 95 degrees centigrade and 80 rpm. The molten extrudate is collected in a water tank and later dried at room temperature. The extruded strands are broken into particles having a size of 850 microns or smaller using a Fitzmill. Further particle size reduction is carried out using an 8-inch Sturtevant micronizer to produce particles having a volume median diameter of about 14 microns, measurable with a Coulter counter model TA II. Fines in the particles are subsequently removed with a Donaldson classifier. The classified toner is then coated with 2% by weight of conductive carbon black, specifically Vulcan XC72R carbon black, in the Labmaster blender for 2 minutes at a low agitating bar speed of 1000 rpm, followed by 10 minutes of mixing at a higher speed of 2500 rpm. The coated toner then undergoes heat treatment in a fluidized bed dryer, wherein the toner particles are suspended in hot air and heated to a temperature close to or above the glass transition temperature of the toner resin (in this case, the inlet air temperature is in the range of 90° C.-120° C.) for a period of about 60 minutes. During heat treatment, the carbon black particles are fused onto the softened surface of the toner particles. After completion of the heat treatment, the toner particles are cooled to a temperature below the glass transition temperature of the resin (in this case, the particles are cooled to below 50° C.). The cooled particles are then removed from the fluidized bed dryer and classified with a Donaldson classifier to remove excessive carbon black and fines.

Prior to its heat treatment, the toner generally has a conductivity in the range of from about $10^{-8}$ to about $10^{-10}$ $ohm^{-1}cm^{-1}$. After heat treatment, the toner has a conductivity of $10^{-4}$ to $10^{-8}$ $ohm^{-1}$-$cm^{-1}$, which is a $10^2$ to $10^4$ increase over the conductivity of the non-heat treated toner.

While the invention has been described with reference to the embodiments disclosed herein, it is not confined to the details set forth and encompasses such modifications or changes as may come within the purpose of the invention.

What is claimed is:

1. A method for making conductive toner particles, comprising (A) heat treating in fluidized bed processing equipment a mixture of non-conductive toner particles comprising a thermoplastic resin and a colorant, and an effective amount of conductive powder blended with and coated on surfaces of the non-conductive toner particles, wherein said heat treatment is carried out at a temperature at or above the glass transition temperature of the resin for a period of time at least sufficient to fuse the conductive powder onto the surfaces of the non-conductive toner particles, and then (B) cooling the heated toner particles to a temperature below the glass transition temperature of the resin.

2. A method according to claim 1, wherein the non-conductive toner particles have a volume average particle diameter of less than 20 microns.

3. A method according to claim 1, wherein the non-conductive toner particles have a volume average particle diameter of from about 7 to about 18 microns.

4. A method according to claim 1, wherein the thermoplastic resin is a polyester resin.

5. A method according to claim 4, wherein the mixture of non-conductive toner particles and conductive powder is heated to a temperature in the range of from about 90° to about 120° C. in said fluidized bed processing equipment.

6. A method according to claim 1, wherein the colorant is a magnetic colorant.

7. A method according to claim 6, wherein the magnetic colorant is magnetite.

8. A method according to claim 1, wherein the conductive powder is conductive carbon black, a metal, a metal alloy, or a metal oxide.

9. A method according to claim 1, wherein the effective amount of conductive powder is an amount sufficient to provide toner particles having a conductivity of at least about $10^{-8}$ $ohm^{-1}$-$cm^{-1}$.

10. A method according to claim 1, wherein the effective amount of conductive powder is an amount sufficient to provide toner particles having a conductivity in the range of from about $10^{-4}$ to about $10^{-8}$ $ohm^{-1}$-$cm^{-1}$.

11. A method according to claim 1, wherein the effective amount of conductive powder is from about 0.5 to about 5 parts by weight per 100 parts by weight of the non-conductive toner.

12. A method according to claim 1, wherein the mixture of non-conductive toner particles and conductive powder is heated to a temperature in the range of from about 80° to about 150° C. in said fluidized bed processing equipment.

13. A method according to claim 1, wherein the mixture of non-conductive toner particles and conductive powder is heated for a period of at least about 30 minutes in said fluidized bed processing equipment.

14. A method according to claim 1, wherein the mixture of non-conductive toner particles and conductive powder is heated for a period ranging from about 30 minutes to about 200 minutes in said fluidized bed processing equipment.

15. A method according to claim 1, wherein the fluidized bed processing equipment is batch fluidized bed processing equipment.

16. A method according to claim 1, wherein the fluidized bed processing equipment comprises a laminated membrane filter bag wherein a tetrafluoroethylene fluorocarbon membrane is bonded to a polyester or nylon substrate; and a product container having a 200–400 mesh stainless steel screen bottom.

17. A method for making conductive toner particles, comprising (1) mixing non-conductive toner particles comprising a thermoplastic resin and a colorant with an effective amount of a conductive powder to form a blend of conductive powder coated on surfaces of the non-conductive toner particles; (2) heat treating said blend in fluidized bed processing equipment, wherein said heat treatment is carried out at a temperature at or above the glass transition temperature of the thermoplastic resin for a period of time at least sufficient to fuse the conductive powder onto the surfaces of the non-conductive toner particles; (3) cooling the heated toner particles to a temperature below the glass transition temperature of the resin; (4) removing the cooled toner particles from the fluidized bed processing equipment; and (5) classifying the toner particles.

* * * * *